US005624181A

United States Patent [19]

Miller et al.

[11] Patent Number: 5,624,181

[45] Date of Patent: Apr. 29, 1997

[54] LIGHTED DISPLAY USING DECORATIVE LIGHT STRING

[76] Inventors: Kenneth C. Miller, 280 Easy St. #117, Mountain View, Calif. 94043; Warren D. Hyland, 1720 W. Mountain Ave., Ft. Collins, Colo. 80521; David A. Greenlee, P.O. Box 4516, Troy, Mich. 48099

[21] Appl. No.: 553,181

[22] Filed: Nov. 7, 1995

[51] Int. Cl.[6] ..... F21V 33/00; F21L 15/08

[52] U.S. Cl. ..... 362/252; 362/103; 362/808; 362/234; 428/9

[58] Field of Search ..... 362/103, 234, 362/249, 252, 253, 806, 807, 808, 121; 428/7, 9, 12, 131, 904.4

[56] References Cited

U.S. PATENT DOCUMENTS

| | | | |
|---|---|---|---|
| D. 84,807 | 8/1931 | Buschman . | |
| 2,722,317 | 11/1955 | Goodwin . | |
| 3,731,081 | 5/1973 | Yellin . | |
| 4,164,008 | 8/1979 | Miller et al. | 362/252 |
| 4,308,572 | 12/1981 | Davidson et al. | 362/103 |
| 4,769,749 | 9/1988 | Felski . | |
| 4,795,121 | 1/1989 | Comito . | |
| 4,823,240 | 4/1989 | Shenker | 362/806 |
| 4,966,793 | 10/1990 | Covell | 362/226 |
| 4,995,181 | 2/1991 | Wolf | 40/152.2 |
| 5,113,325 | 5/1992 | Eisenbraun | 362/103 |
| 5,366,780 | 11/1994 | Rapisarda | 362/103 |
| 5,519,595 | 5/1996 | Wang | 362/252 |

*Primary Examiner*—Ira S. Lazarus
*Assistant Examiner*—Thomas M. Sember
*Attorney, Agent, or Firm*—David A. Greenlee

[57] ABSTRACT

A lighted display features a decorative mounting board having an outer display surface and a rear surface. A string of lights has a plurality of bulb sockets which mount bulbs in their openings and are interconnected by electrical wiring. The bulb lighting portions each have a diameter smaller than the diameter of a socket. A plurality of apertures are arranged in a predetermined decorative pattern on the board. Each aperture is sized to enable insertion of a bulb lighting portion, but presents a barrier preventing reception of a socket. The perimeter of surrounding board material provides a resilient edge which grips the bulb lighting portions. The string of lights is mounted to the board by inserting the bulb lighting portions into said apertures from the rear surface until the sockets engage the aperture perimeters. Upon illumination, the lighted string of lights provides an illuminated outline of the predetermined pattern defined by the apertures, which may be informative, as with words, or a decorative, such as a figure. The lights are easily inserted and removed for selective use in a plurality of such displays.

17 Claims, 3 Drawing Sheets

FIG 2
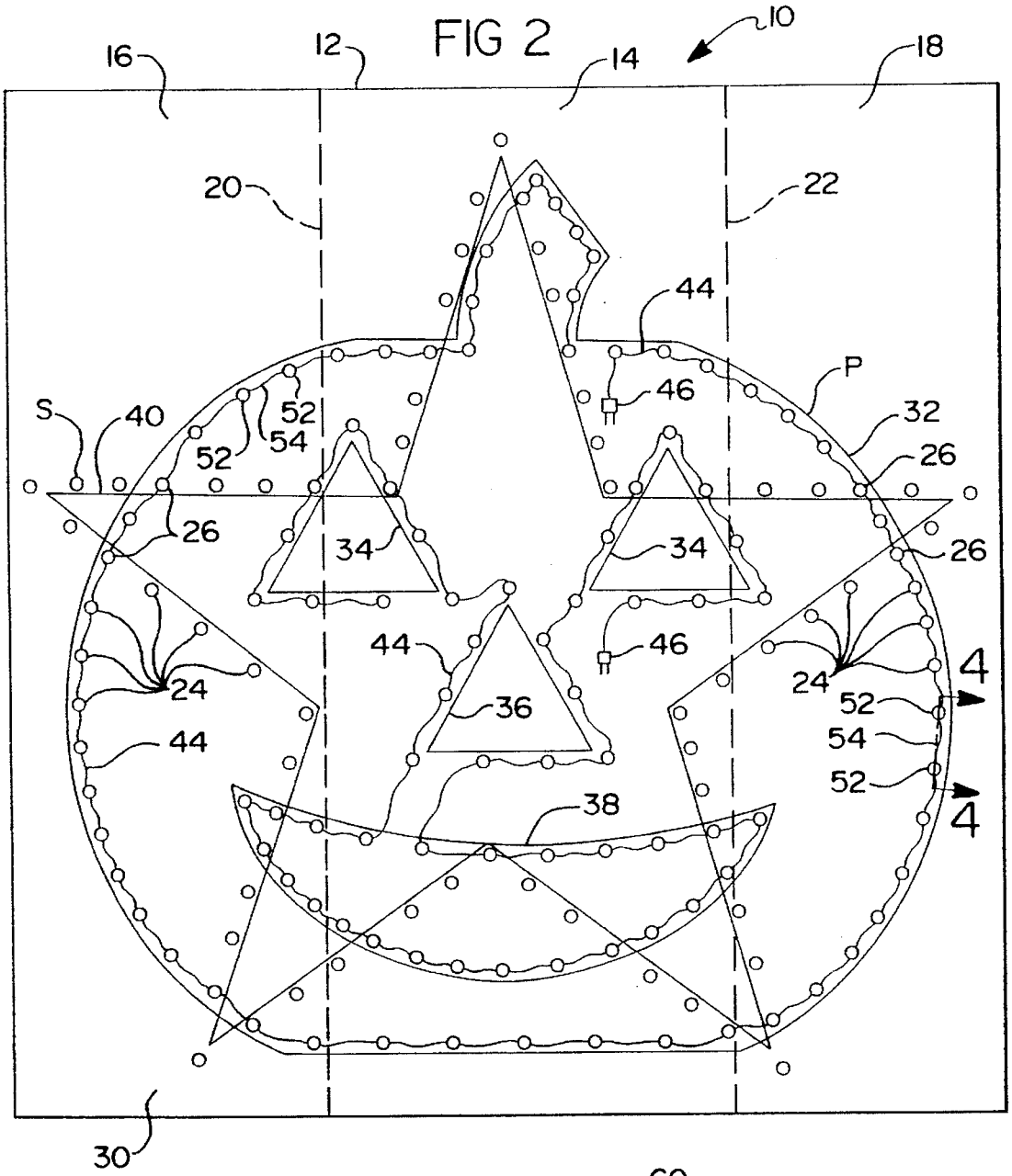
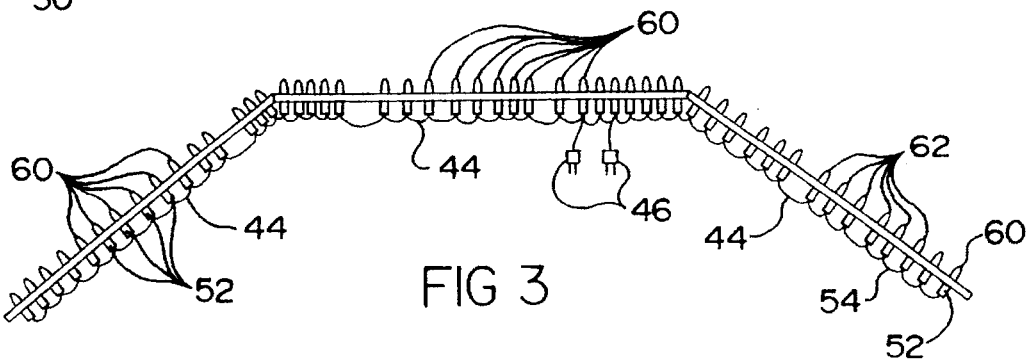
FIG 3

FIG 4
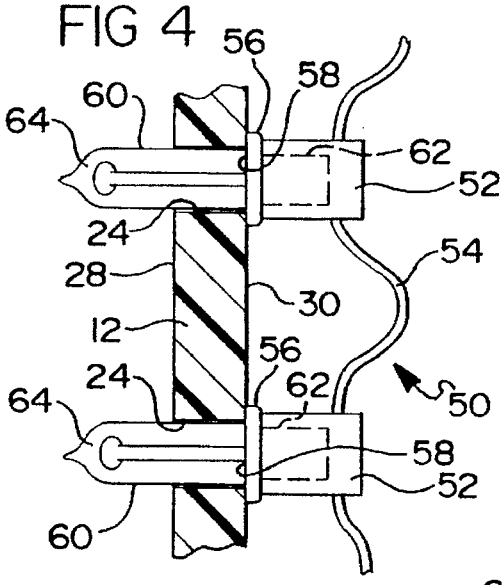
FIG 5a
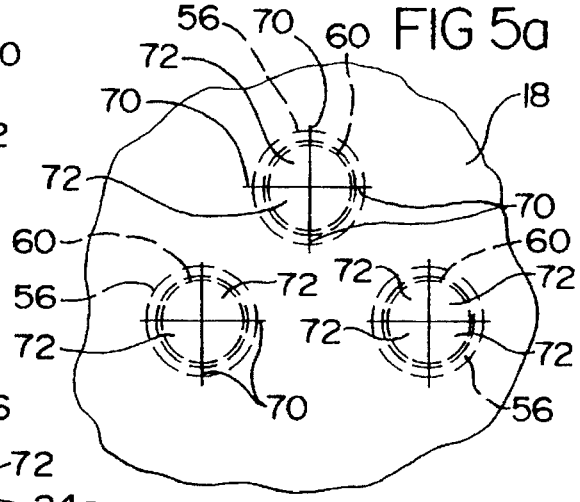
FIG 5b
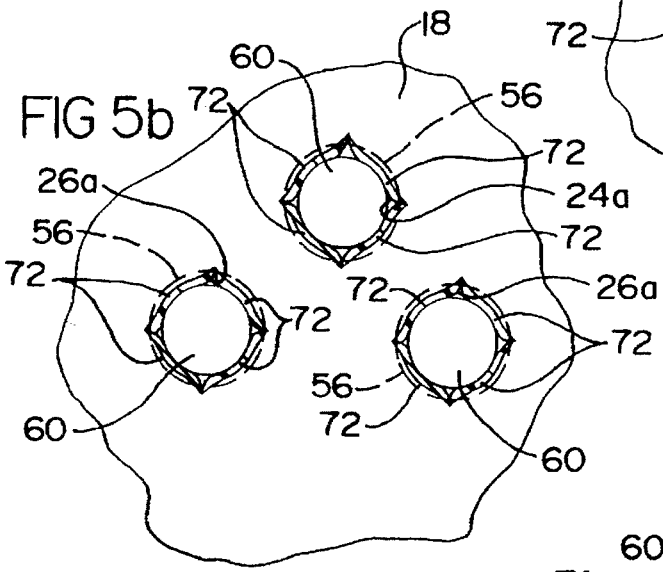
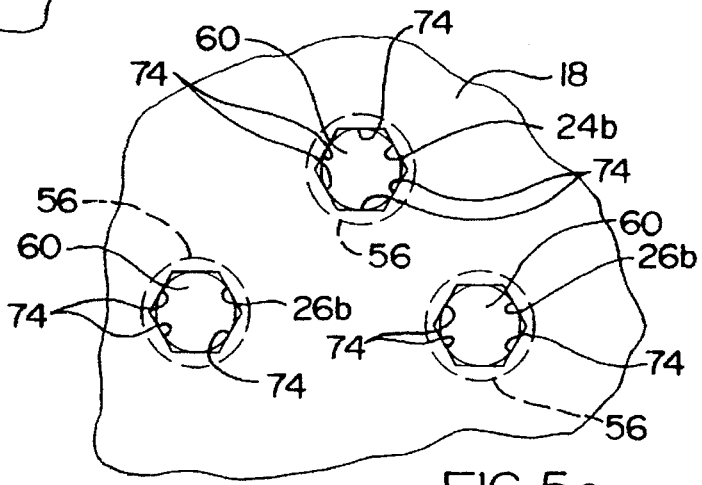
FIG 5c

LIGHTED DISPLAY USING DECORATIVE LIGHT STRING

BACKGROUND OF THE INVENTION

This invention relates generally to a lighted decorative display which utilizes a string of decorative lights mounted in a predetermined configuration, and, more particularly, to a mounting arrangement for displaying one or more strings of so-called "Christmas tree lights" in a predetermined decorative configuration on a decorative support surface.

Lighted signs and displays of all types have been used for years to convey information or to provide a decorative sign. A number of patents have issued which provide a support for mounting and displaying strings of Christmas tree lights. None of these have proved commercially successful.

In U.S. Pat. No. 3,731,081—Yellin, a string of lights is mounted on a decorative support by clamping the tops of plastic mountings projecting from the support between the bulb and socket. This arrangement requires separation of the bulb from its socket and reassembly only after the bulb socket is mounted.

Another patent U.S. Pat. No. 4,995,181—Wolf discloses an adjustable frame which mounts a string of decorative lights for placement in a window. The frame includes a continuous slot having spaced annular enlargements. The lights are mounted by inserting the string wire in the slots and inserting the bulb sockets into these enlargements from the front so that the frame grips the sockets.

In U.S. Pat. No. 4,769,749—Felski a shaped frame has a series of side entry apertures through which the wiring is threaded with a socket inserted from the front into some apertures. A similar arrangement is shown in U.S. Pat. No. 4,795,121—Comito in which an angled frame has apertures for front entry of the sockets, with side slots to accommodate the wiring.

All of the above arrangements for mounting a lighting string require entering the bottoms of the sockets into apertures, with relief slots to hide the wiring, or inserting empty sockets and inserting bulbs later. All require special mounting arrangements for the bulbs and their sockets. None of these prior art lighting string mounting arrangements on support boards provides for a decorative display which simply uses a smooth surfaced mounting board that mounts strings of lights without modification and none are extremely inexpensive and easy to rise.

Accordingly, there is a need for a lighted display which inexpensively, easily and simply mounts one or more strings of lights in a predetermined pattern.

SUMMARY OF THE INVENTION

It is therefore an object of this invention to provide a lighted display which inexpensively, easily and simply mounts one or more strings of lights in a predetermined pattern.

In one aspect, this invention features a mounting support for mounting a string of lights which comprise a plurality of spaced sockets that are interconnected by electrical wiring and each mount an elongated bulb having a lighting portion smaller than the surrounding socket. The support comprises a sheet of resilient support material having a plurality of spaced perforations formed into a predetermined pattern, each perforation being sized to admit insertion of a bulb lighting portion therethrough. The support material surrounding the perforations frictionally grips the bulb lighting portions when inserted and provides a barrier to prevent insertion of the sockets into the perforations.

In another aspect, this invention features a lighted display comprising a decorative mounting board having an outer display surface and a rear surface and a string of lights comprising a plurality of bulb sockets each having a bulb-receiving opening, electrical wiring interconnecting the bulb sockets, and a plurality of bulbs each having a base received in a socket and having a lighting portion. The bulb lighting portions each have a diameter smaller than the diameter of a socket. The mounting board has a plurality of apertures arranged in a predetermined pattern on the board. Each aperture is defined by a perimeter of board material which provides a resilient edge for receiving and gripping the bulb lighting portions, but presents a barrier preventing reception of a socket. The string of lights is mounted to the board by inserting the bulb lighting portions into the apertures from the rear surface until the sockets engage the aperture perimeters.

Preferably, the plurality of apertures forms a plurality of different predetermined patterns to enable forming different lighted displays on the same board, and each predetermined pattern is outlined on the rear surface to form a guide for inserting the bulb lighting portions to produce a lighted display of a selected predetermined pattern.

In still another aspect, this invention features a lighted display comprising a decorative mounting board that has hinged segments that are relatively foldable to enable angulation of relative angulation of the segments to provide a lighted display in angled planes or to enable storage.

These and further objects and features of this invention will become more readily apparent upon reference to the following detailed description of a preferred embodiment, as illustrated in the accompanying drawings, in which:

BRIEF DESCRIPTION OF THE DRAWINGS

FIG. 2 is a rear elevation of a lighted display according to this invention;

FIG. 3 is a top view of the lighted display, illustrated as partially folded to provide an angled display;

FIG. 4 is an enlarged sectional view taken along line 4—4 of FIG. 2;

FIG. 5*a* is an enlarged detail view of the circled segment of FIG. 1 denoted "A";

FIG. 5*b* is a view similar to FIG. 5*a*, but illustrating another embodiment; and FIG. 5*c* is a view similar to FIG. 5*a*, but illustrating yet another embodiment.

DETAILED DESCRIPTION OF A PREFERRED EMBODIMENT

Figure 1:
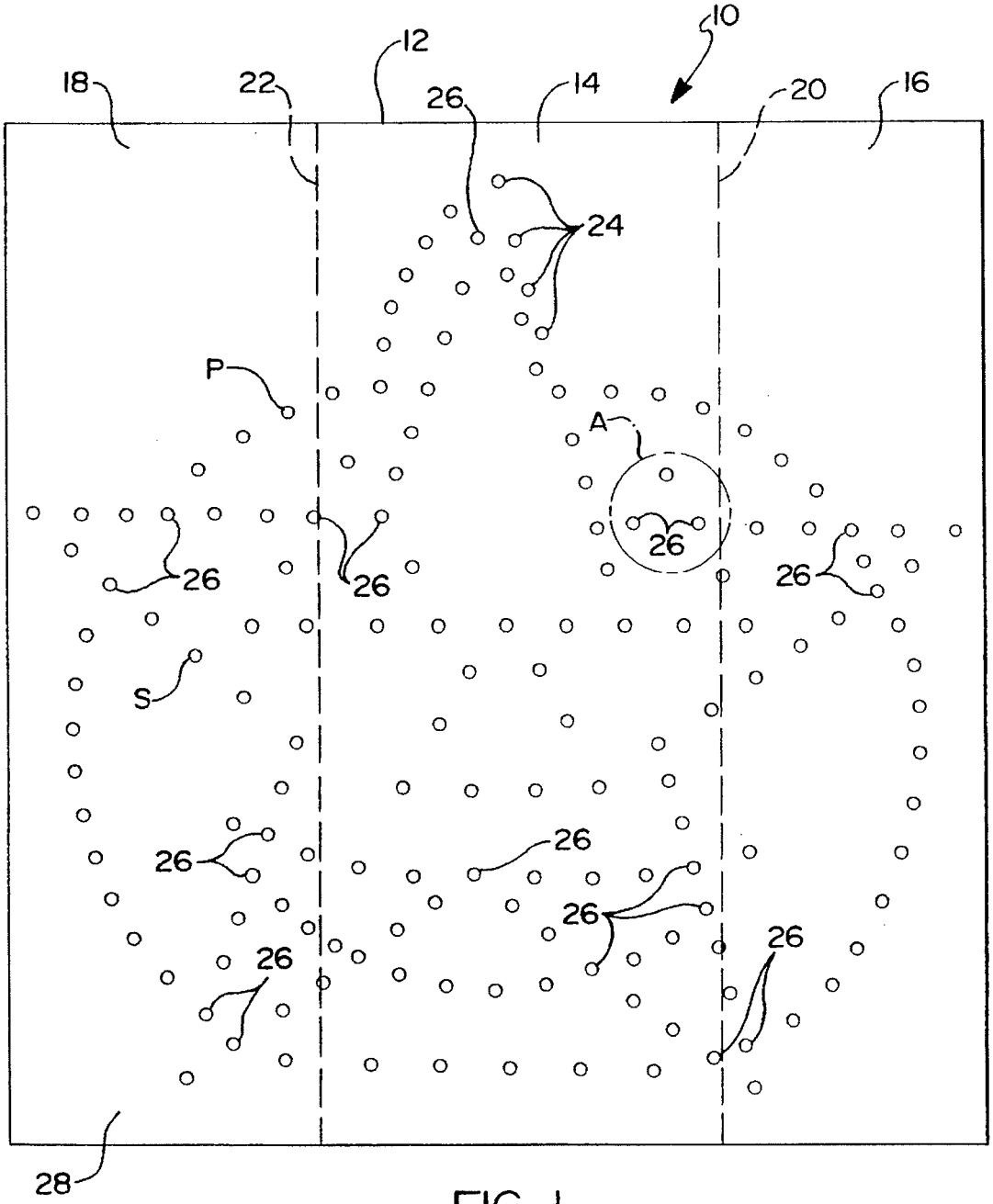
FIG. 1 is a front elevation of a lighted display according to this invention.

Referring to FIGS. 1 and 2, a lighted display 10 includes a mounting board or support 12 that can be of any shape, but is preferably rectangular, as illustrated. Board 12 is formed of a central segment 14 which is connected to side segments 16 and 18 by creases or indented hinge or fold lines 20 and 22, as illustrated.

Board 12 has a plurality of apertures 24, 26 formed in it. These apertures 24, 26 are round holes that extend through board 12, from the outer display surface 28 to the rear surface 30, and are arranged in predetermined patterns to form two decorative figures, shown here as a pumpkin P, and a star S. The apertures forming the pumpkin pattern P are indicated by an outline 32, indicating the periphery, and outlines 24, 36 and 38, indicating eyes, nose and mouth, which are marked on rear surface 30. Similarly, the apertures forming the star pattern S are indicated by outline 40. All apertures are equally sized, but apertures 24 are unique to one of the patterns, while apertures 26 are common to both patterns P and S.

To provide a display of a lighted pumpkin on outer display surface 28, one or more strands or strings 44 of lights are inserted into the apertures 24, 26 which comprise pattern P. FIG. 2 illustrates the use of two such strings, having terminal plugs 46 for insertion into an extension cord for connection to a wall socket (neither shown) to illuminate the pumpkin of pattern P. A base (not shown) may be provided to maintain mounting board vertical, or board 12 may be propped against a vertical wall or other support. Alternatively, folded wings or any of the devices that are commonly used with cardboard signs or figures could be used to prop up board 12.

Each string of lights is preferably a commercially-available string of decorative lights, commonly known as "miniature Christmas lights", comprising a plurality of multi-colored or single color low voltage bulbs. Such strings are readily commercially available in sets of 20, 35, 50 or 100 lights. The lights are inserted into apertures 24, 26 easily and quickly, as will now be discussed in reference to FIG. 4.

Each string of lights 50 comprises a plurality of bulb sockets 52 that are interconnected by electrical wiring 54. Each socket 52 has a flanged top 56, much larger in diameter than aperture 24, which flanks an opening 58. Each bulb 60 includes a base 62 and a lighting portion 64, which is slightly larger than aperture 24. Since the board material is resilient, bulb lighting portion 64 can be inserted into apertures 24 and 26 by pushing it into the aperture until socket flange 56 engages board rear surface 30 which presents a barrier to further insertion. On some light strings, the socket top 56 is a flange, while some light strings use bulbs that have base flanges. In either arrangement, this flange or top is sufficiently large to prevent insertion of the socket into aperture 24. After insertion, the resilient material on the periphery of each aperture grips the bulb lighting portion 64 to retain the bulbs 60 in the apertures.

The lighting portion of all bulbs used in commercially-available strings of miniature decorative lights have substantially the same diameter, although many different types of bases are used. Some bulbs are straight and have screw base connections, while others have a friction retention and have a flange at the top of their bases. By sizing the apertures slightly smaller than the bulb lighting portion, the bulbs can be easily inserted and the resilience of the board material will tightly grip and retain them. It is not necessary to remove the bulbs from the sockets to insert the bulbs into the board or to remove them. No other connectors or clips are necessary to effectively retain the bulbs in the boards until purposefully removed by merely pulling them out. Simply push to insert and pull to remove.

The sizing of the apertures relative to the size of the bulb lighting portion will depend on the material used for the board. With more resilient and/or thinner material, there should be a larger difference between bulb and aperture diameters. A smaller diameter difference should be used with less resilient and/or thicker material. Apertures 24, 26 may take many different forms, other than a round hole. Two of these alternative apertures are shown in FIGS. 5*a*, 5*b* and 5*c*.

In FIG. 5*a*, the board material 18 includes a plurality of crossed slits 70 shown just prior to insertion of bulb lighting portions 62. Upon insertion, bulb lighting portions force flaps 72 to open and form apertures 24*a*, 26*a*. Flaps 72 deform or flex to enable full insertion of bulb portions 62, as illustrated in FIG. 5*b*, and tightly grip bulbs 60. Slits 70 are sized to form flaps 72 which will admit insertion of bulb lighting portions 62, but prevent insertion of sockets 56. The bulbs are readily removed by grasping and pulling on sockets 52. This arrangement is particularly useful with a base 12 made of cardboard.

FIG. 5*c* illustrates another form of apertures 24*b*, 26*b* which are hexagonal in shape. The distance across the sides of the hexagon is smaller than the diameter of bulb lighting portion 62. Upon insertion, lighting portion 62 will deform the resilient sides 74 which will grip the portions 62 after insertion. This type of aperture is useful with a less resilient and, hence deformable, material, such as a plastic. Of course other polygonal shapes can be used. Also, non-round (e.g. oval) apertures could be used, just so that there is one cross aperture dimension that is smaller than the bulb lighting portion diameter to provide gripping upon insertion and a barrier to socket insertion.

Fold lines 20 and 22 permit segments 18 and 20 to be angled relative to segment 14 to provide a lighted display in angled planes, as shown in FIG. 3. This would eliminate the necessity of providing a base or other support for mounting board 12. These fold lines can also form hinges to permit side segments 16 and 18 to be folded upon central segment 16 for more compact storage.

Although the apertures are illustrated as forming two patterns of decorative figures, they could be formed into one, three or more patterns of decorative figures, or into patterns forming messages, such as "HAPPY 40TH BIRTHDAY". These patterns can also be outlined on the outer display surface 30, if desired. The patterns chosen, the number used, and their arrangement on the board will dictate how many apertures will be common to more than one figure. The structural integrity of board 12 is enhanced by the use of as few apertures as possible. Thus, it is preferable to maximize the use of apertures 26 and minimize the use of apertures 24 for multi-pattern boards.

Although strings of miniature Christmas lights are used in this illustrative example, strings of other sizes of commercially-available lights can be used, as can strings of specially spaced lights. It is desirable to use all of the lights in each strand. To do this, the apertures in the patterns should be spaced in a manner to conform to the maximum space between light sockets insofar as possible. Should a pattern require adjacent apertures to be spaced further apart than socket spacing, or should there be fewer apertures than lights, one or more lights can be hidden from view behind the board, so long as the board is opaque.

Board 12 may be made of corrugated cardboard, plastic, foam board, or any other similar material which is inexpensive and preferably has sufficient rigidity to maintain its shape during repeated usage. Alternatively, the lighted display 10 could be formed of a flexible sheet mounted on a frame. This would enable rolling of the board for compact storage. The board should be thinner than the length of the bulb lighting portions to enhance the display.

Although illustrated as foldable, board 12 may be made of a single rigid sheet of suitable material that does not fold. It could also be formed as a single sheet of thin plastic that has integrally-formed strengthening ribs. In any event, it is desirable that board 12 have structural integrity and be inexpensive.

Lighted display 10 may be used indoors or outdoors. If outdoor use is contemplated, it is desirable that board 12 be made of a suitable weatherproof material, such as plastic or coated cardboard.

While only a preferred embodiment and variants have been illustrated and described, obvious modifications thereof are contemplated within the scope of this invention and the following claims.

We claim:

1. A mounting support for mounting a string of lights which comprises a plurality of spaced sockets that are interconnected by electrical wiring, each socket mounting an elongated bulb having a lighting portion smaller than the surrounding socket, said support comprising a sheet of resilient support material having a plurality of spaced apertures formed into a predetermined pattern, each aperture being sized to enable forced insertion of a bulb lighting portion therethrough and to enable the support material surrounding the aperture to frictionally grip the bulb lighting portion when inserted and provide a barrier to prevent insertion of the sockets into said apertures, whereby the frictional gripping of the bulb lighting portions by the support material provide the only means securing the bulb lighting portions to the mounting support.

2. The mounting support of claim 1, wherein the apertures are round.

3. The mounting support of claim 1, wherein the apertures are polygonal shapes.

4. The mounting support of claim 1, wherein the apertures are defined by cuts in the surrounding material creating flexible flaps which open to form the aperture and grip the bulb lighting portions when inserted.

5. The mounting support of claim 1, wherein the apertures are smaller in diameter than the bulb lighting portions.

6. The mounting support of claim 1, wherein the resilient support material is cardboard.

7. The mounting support of claim 1, wherein the resilient support material is plastic.

8. The mounting support of claim 7, wherein the resilient support material is a sheet of plastic foam.

9. The mounting support of claim 8, wherein the sheet of plastic foam is thinner than the length of the inserted bulb lighting portions.

10. The mounting support of claim 1, wherein the resilient support material is corrugated cardboard.

11. A lighted display comprising a decorative mounting board comprising a sheet of material having an outer display surface and a rear surface, a string of lights comprising a plurality of bulb sockets each having a bulb opening, electrical wiring interconnecting the bulb sockets, and a plurality of bulbs each having a base received in a socket and having a lighting portion extending therefrom, said bulb lighting portions each being smaller than the socket, a plurality of apertures arranged in a predetermined pattern on the board, each aperture being defined by a perimeter of the board material providing a resilient edge for receiving and gripping the bulb lighting portions, but presenting a barrier preventing reception of a socket, whereby said string of lights is mounted to said board to form a lighted display by inserting the bulb lighting portions into said apertures from the rear surface until the sockets engage the aperture perimeters, and the frictional gripping of the bulb lighting portions by the board material provide the only means securing the bulb lighting portions to the mounting board.

12. The lighted display of claim 11, wherein the plurality of apertures forms a plurality of different predetermined patterns to enable forming different lighted displays on the same board.

13. The lighted display of claim 12, wherein at least two of the predetermined patterns intersect to enable one or more apertures to be utilized in at least two predetermined patterns.

14. The lighted display of claim 12, wherein each predetermined pattern is outlined on the rear surface to form a guide for inserting the bulb lighting portions to produce a lighted display of a selected predetermined pattern.

15. The lighted display of claim 14, wherein the mounting board is generally rectangular.

16. The lighted display of claim 15, wherein the mounting board comprises defined segments connected by fold lines enabling folding of the board for storage.

17. The lighted display of claim 14, wherein the mounting board comprises defined segments connected by hinge lines enabling relative angulation of the segments to provide a lighted display in angled planes.

* * * * *